US010208662B2

(12) United States Patent
Watanabe

(10) Patent No.: US 10,208,662 B2
(45) Date of Patent: Feb. 19, 2019

(54) INTERNAL COMBUSTION ENGINE

(71) Applicant: TOYOTA JIDOSHA KABUSHIKI KAISHA, Toyota-shi, Aichi-ken (JP)

(72) Inventor: Masaki Watanabe, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 80 days.

(21) Appl. No.: 15/432,204

(22) Filed: Feb. 14, 2017

(65) Prior Publication Data

US 2017/0298815 A1 Oct. 19, 2017

(30) Foreign Application Priority Data

Apr. 14, 2016 (JP) ..... 2016-081381

(51) Int. Cl.
*F02B 75/04* (2006.01)
*F02F 7/00* (2006.01)

(52) U.S. Cl.
CPC ..... *F02B 75/041* (2013.01); *F02F 7/0043* (2013.01)

(58) Field of Classification Search
CPC ..... F02B 75/041; F02F 7/0043
USPC ..... 123/48 C
See application file for complete search history.

(56) References Cited

U.S. PATENT DOCUMENTS

2010/0163002 A1* 7/2010 Kamiyama ..... F01N 13/102 123/48 C
2011/0114063 A1* 5/2011 Akihisa ..... F02D 13/0234 123/48 C
2015/0233309 A1* 8/2015 Tanaka ..... F02D 15/04 123/48 C

FOREIGN PATENT DOCUMENTS

| | | | |
|---|---|---|---|
| GB | 2 406 614 | A | 4/2005 |
| JP | H6-504826 | A | 6/1994 |
| JP | 2012-219745 | A | 11/2012 |
| JP | 2013-194607 | A | 9/2013 |
| JP | 2014-092080 | A | 5/2014 |
| WO | 92/09798 | A1 | 6/1992 |

* cited by examiner

*Primary Examiner* — Marguerite McMahon
(74) *Attorney, Agent, or Firm* — Hunton Andrews Kurth LLP

(57) ABSTRACT

An internal combustion engine provided with a cylinder block which can move relative to a crankcase is provided with a block movement mechanism arranged at just one side of the left and right of the internal combustion engine, a support member supporting a side surface of the cylinder block, and a pushing member pushing against a side surface of the cylinder block at the opposite side to the side surface supported by the support member. Further, the support member supports the side surface of the cylinder block at the side of arrangement of the block movement mechanism, while the pushing member pushes against the side surface of the cylinder block at the opposite side to the side of arrangement of the block movement mechanism.

5 Claims, 14 Drawing Sheets

INTERNAL COMBUSTION ENGINE

CROSS-REFERENCE TO RELATED APPLICATION

This application claims priority based on Japanese Patent Application No. 2016-081381 filed with the Japan Patent Office on Apr. 14, 2016, the entire contents of which are incorporated into the present specification by reference.

TECHNICAL FIELD

Embodiments of the present invention relates to an internal combustion engine.

BACKGROUND ART

JP2012-219745A discloses as a conventional internal combustion engine provided with a cylinder block able to move relative to a crankcase, one provided with two eccentric shafts (cam shafts) arranged at the two sides of the internal combustion engine and one drive shaft made to rotate by an actuator and making the eccentric shafts rotate in opposite directions to each other to make the cylinder block move relatively. In this conventional internal combustion engine, further, to keep the cylinder block from tilting in a direction different from the direction of relative movement, one side surface of the cylinder block is pushed by pushing members (biasing mechanism) while the other side surface of the cylinder block is supported by support members.

SUMMARY

In this way, in a conventional internal combustion engine, eccentric shafts have to be arranged at the sides of the cylinder block and a drive shaft has to be arranged to make the eccentric shafts rotate in opposite directions from each other. For this reason, there is the problem that the internal combustion engine becomes larger in size overall and the weight of the internal combustion engine increases.

Further, when pushing against one side surface of the cylinder block by pushing members and supporting the other side surface by support members, when moving the cylinder block, resistance (sliding resistance) occurs between the side surfaces of the cylinder block and surfaces of the pushing members and support members abutting against the side surfaces of the cylinder block.

Here, to keep the cylinder block from tilting in a direction different from the direction of relative movement, it is necessary to push against the cylinder block by pushing members by a pushing force of at least the load applied from the cylinder block side to the pushing members during operation of the internal combustion engine. However, the larger the pushing force by the pushing members, the greater the force by which the pushing members and support members clamp the cylinder block. For this reason, there is the problem that the sliding resistance when moving the cylinder block becomes larger and the load when moving the cylinder block, that is, the load acting on the actuator, increases.

Embodiments of the present invention was made in view of this problem and has as its object to suppress enlargement of an internal combustion engine provided with a cylinder block able to move relative to a crankcase and thereby suppress an increase in weight and to keep the cylinder block from tilting in a direction different from the direction of relative movement while keeping down the load when moving the cylinder block.

To solve this problem, according to one aspect of the present invention, an internal combustion engine provided with a cylinder block able to move relative to a crankcase comprises a block movement mechanism arranged at just one side of the left and right of the internal combustion engine when viewing the internal combustion engine from an axial direction of a crankshaft supported at the crankcase to be able to rotate and making the cylinder block move relative to the crankcase, a support member supporting a side surface of the cylinder block, and a pushing member pushing the side surface of the cylinder block at the opposite side to the side of arrangement of the block movement mechanism. The block movement mechanism comprises a single control shaft supported by one of the crankcase or the cylinder block and having a main shaft part and eccentric parts with an axial center at a position offset by a predetermined amount from the axial center of the main shaft part, coupling members with one end parts of the coupling members attached to the eccentric parts and with the other end parts attached to the other of the crankcase or the cylinder block and connecting the control shaft and the other of the crankcase or the cylinder block, and an actuator for making the control shaft rotate within a predetermined range of rotation in both directions to make axial center of the eccentric parts swing about the axial center of the main shaft part in the direction of relative movement of the cylinder block. The support member is configured to support the side surface of the cylinder block at the side of arrangement of the block movement mechanism, while the pushing member is configured to push the side surface of the cylinder block at the opposite side to the side of arrangement of the block movement mechanism.

According to the internal combustion engine according to this aspect of the present invention, by just making a single control shaft rotate, it is possible to make the cylinder block move relative to the crankcase through the coupling members. For this reason, a single control shaft need only be arranged at just one side of the left and right of the internal combustion engine and as a result the block movement mechanism can be arranged at just one side of the left and right of the internal combustion engine. Accordingly, there is no need for providing eccentric shafts at the two sides of the internal combustion engine like in the conventional internal combustion engine explained above. Further, there is no need to place a drive shaft for making the two eccentric shafts rotate. It is possible to suppress the enlargement of an internal combustion engine provided with a cylinder block able to move relatively to a crankcase and thereby keep down the increase in weight.

Further, when arranging the block movement mechanism at only one side of the left and right of the internal combustion engine, a block rotating force trying to make the cylinder block rotate to the block movement mechanism side is generated. For this reason, by supporting the side surface of the cylinder block at which the block rotating force acts by a support member, compared with the case of pushing against the side surface of the cylinder block at which the block rotating force acts by a pushing member, even if reducing the pushing force of the pushing member, it is possible to keep the cylinder block from tilting in a direction different from the direction of relative movement. Therefore, since it is possible to reduce the sliding resistance when moving the cylinder block, it is possible to keep the cylinder block from tilting in a direction different from the direction of relative movement while keeping down the load when moving the cylinder block.

DESCRIPTION OF EMBODIMENTS

Below, embodiments of the present invention will be explained in detail with reference to the drawings. Note that in the following explanation, similar component elements will be assigned the same reference notations.

Figure 1:
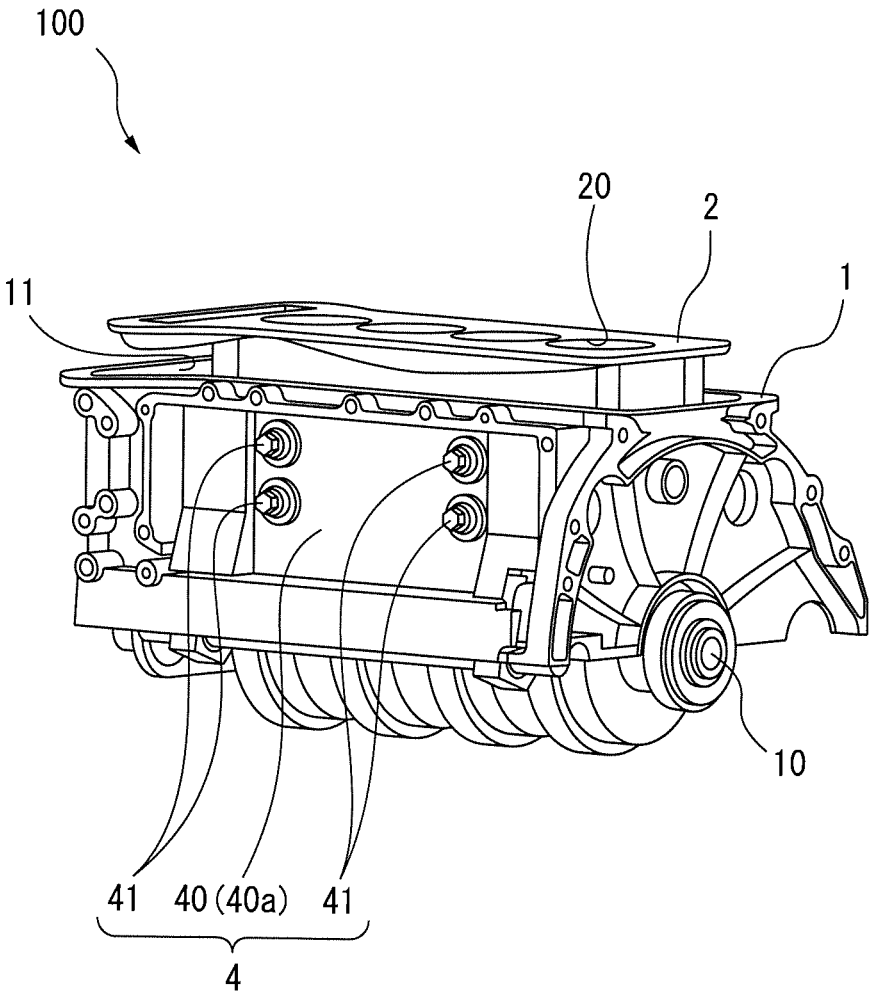
FIG. 1 is a schematic perspective view of an internal combustion engine according to one embodiment of the present invention.
Figure 2:
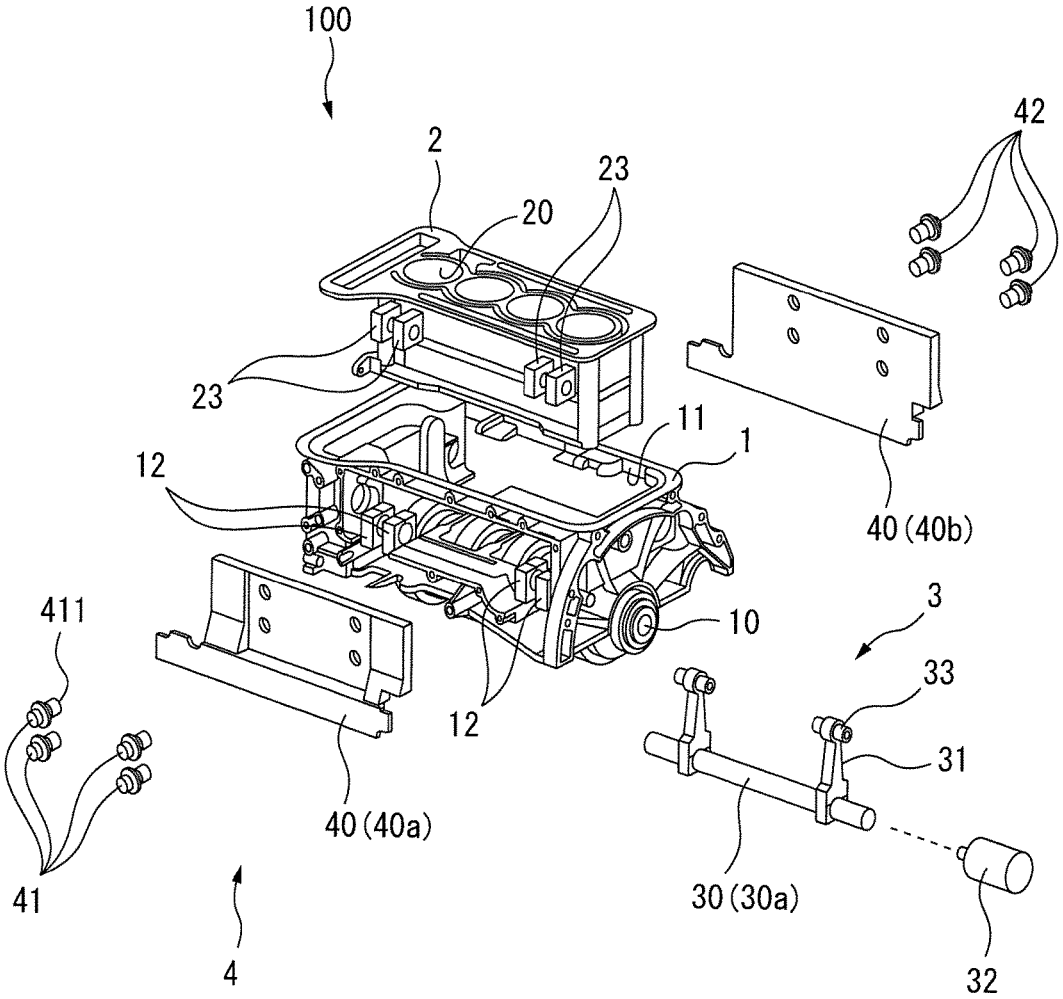
FIG. 2 is a schematic disassembled perspective view of the internal combustion engine shown in FIG. 1.
Figure 2:
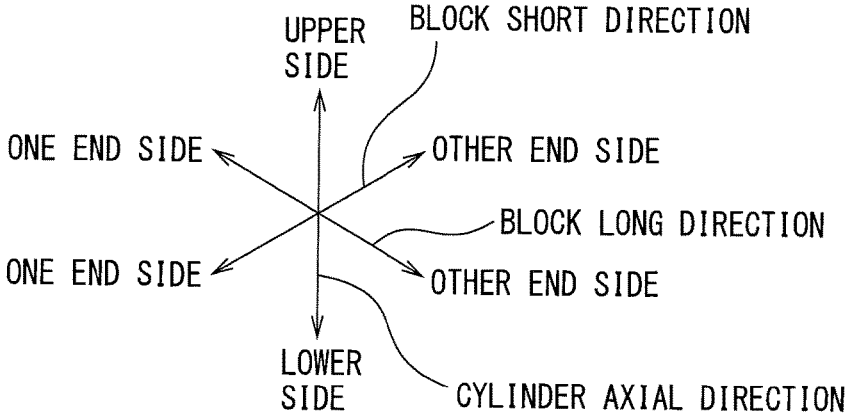
Figure 3:
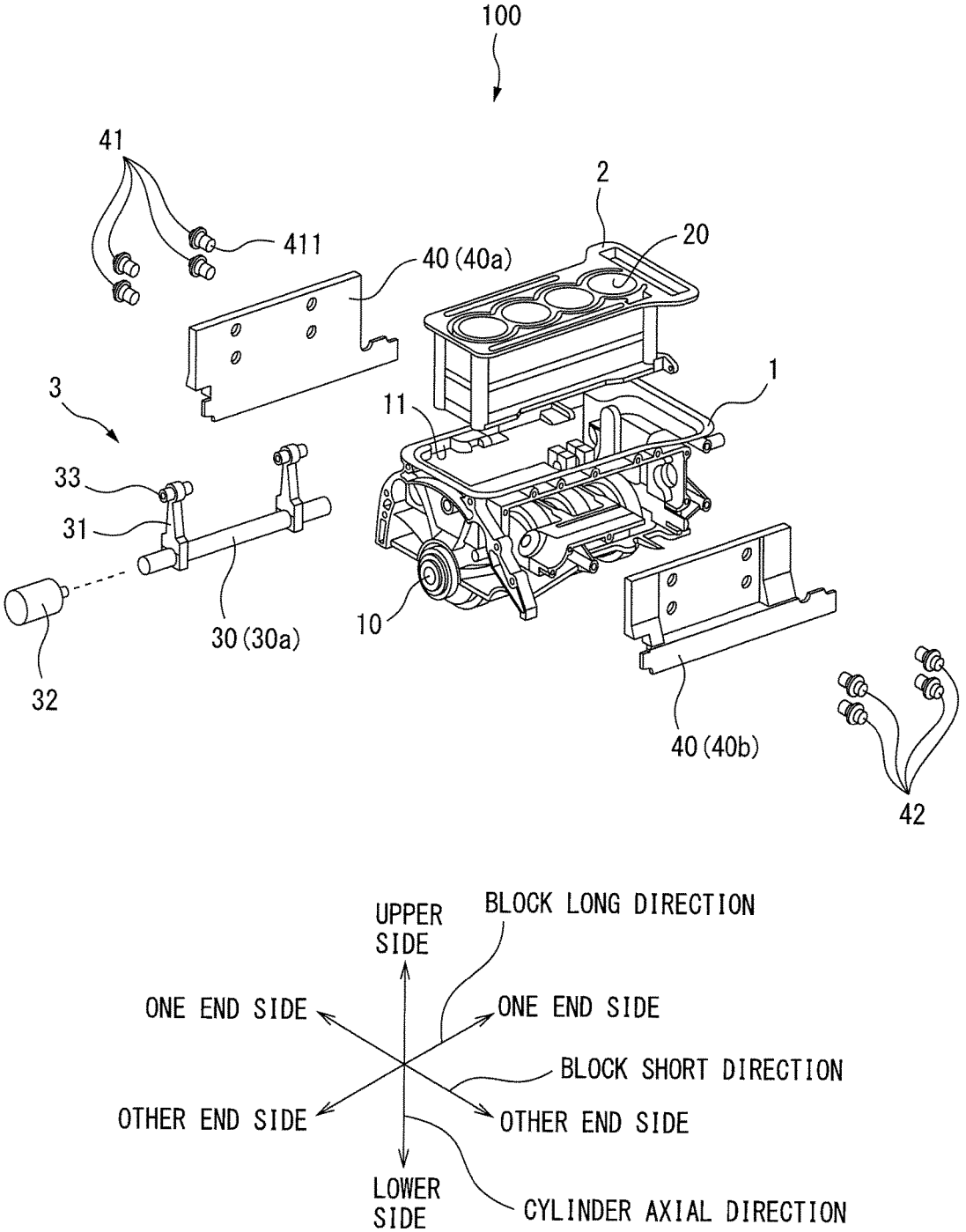
FIG. 3 is a schematic disassembled perspective view of the internal combustion engine shown in FIG. 1.

FIG. 1 is a schematic perspective view of an internal combustion engine 100 according to one embodiment of the present invention. FIG. 2 and FIG. 3 are respectively schematic disassembled perspective views of the internal combustion engine 100 shown in FIG. 1.

As shown from FIG. 1 to FIG. 3, the internal combustion engine 100 is provided with a crankcase 1, cylinder block 2, block movement mechanism 3, and guide mechanism 4.

The crankcase 1 supports a crankshaft 10 to be able to rotate and is provided with a block holding part 11 for holding the cylinder block 2 inside it.

The cylinder block 2 is made a separate member from the crankcase 1 so as to enable relative movement with respect to the crankcase 1. Part of it is held inside the block holding part 11 of the crankcase 1. The cylinder block 2 is formed with cylinders 20. In the present embodiment, four cylinders 20 are formed in series along a long direction of the cylinder block 2 (below, referred to as the "block long direction").

Below, referring to FIG. 4 in addition to FIG. 1 to FIG. 3, the internal configuration of the internal combustion engine 100 and details of the block movement mechanism 3 and guide mechanism 4 will be explained.

Figure 4:
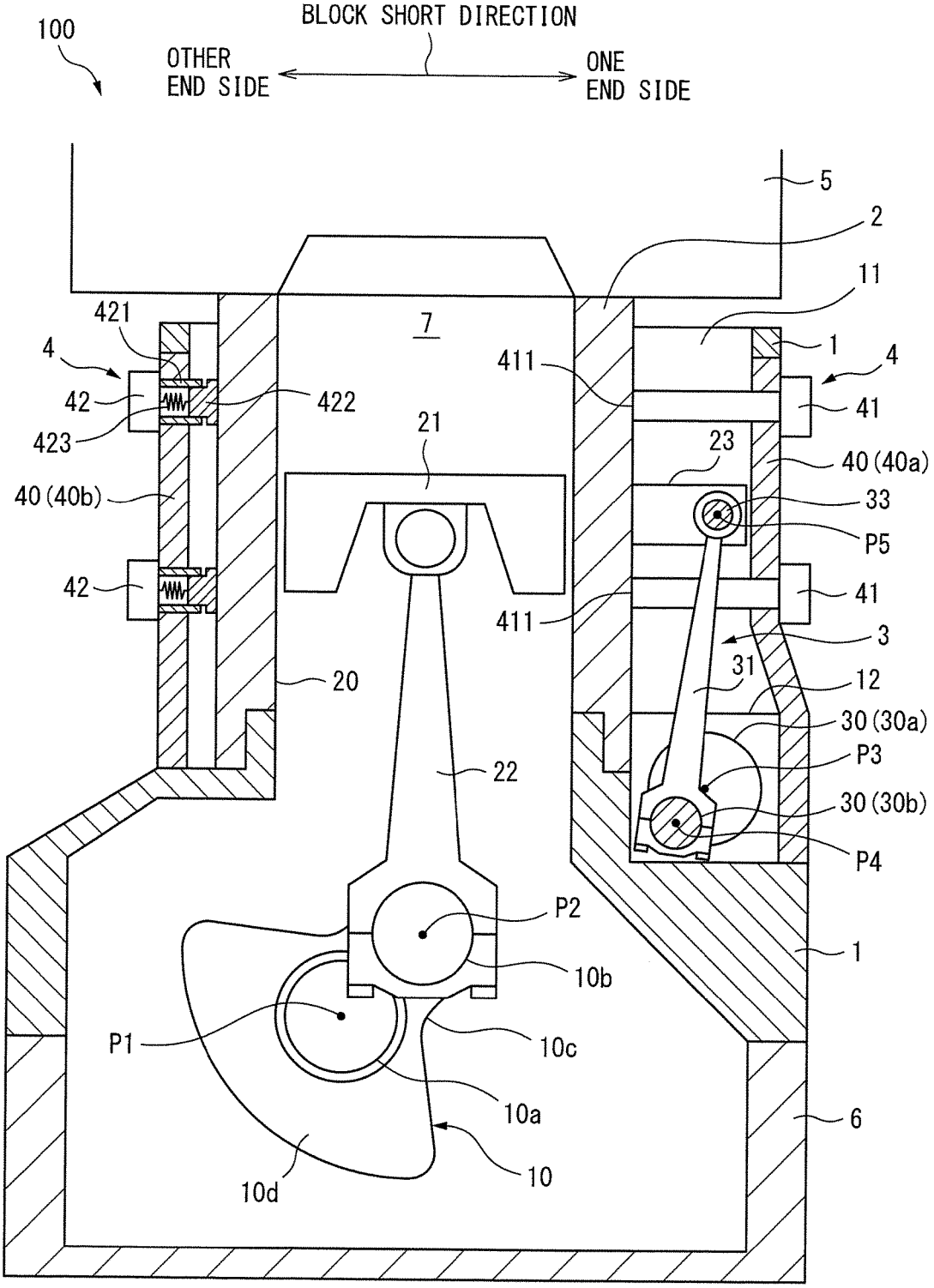
FIG. 4 is a schematic cross-sectional view of an internal combustion engine according to one embodiment of the present invention.

FIG. 4 is a schematic cross-sectional view of the internal combustion engine 100. Note that in FIG. 1 to FIG. 3, to prevent complexity in the drawings, part of the components of the internal combustion engine 100 shown in FIG. 4 are omitted.

As shown in FIG. 4, at the top part of the cylinder block 2, a cylinder head 5 is attached, while at the bottom part of the crankcase 1, an oil pan 6 is attached.

Inside each cylinder 20, a piston 21 receiving combustion pressure and moving in a reciprocating manner inside the cylinder 20 is held. The piston 21 is connected through a connecting rod 22 to a crankshaft 10. Due to the crankshaft 10, the reciprocating motion of the pistons 21 is converted to rotary motion. A space defined by the cylinder head 5, a cylinder 20, and a piston 21 forms a combustion chamber 7.

The crankshaft 10 is provided with crank journals 10*a*, crank pins 10*b*, and crank arms 10*c*.

The crank journals 10*a* are parts supported by the crankcase 1 to be able to rotate. The axial center P1 of the crank journals 10*a* becomes the center of rotation of the crankshaft 10.

The crank pins 10*b* are parts to which the large end parts of the connecting rods 22 are attached. The axial center P2 of the crank pins 10*b* is offset from the axial center P1 of the crank journals 10*a* by exactly a predetermined amount. Therefore, if the crankshaft 10 rotates, the axial center P2 of the crank pins 10*b* rotates about the axial center P1.

The crank arms 10*c* are parts connecting the crank journals 10*a* and the crank pins 10*b*. In the present embodiment, to make the crankshaft 10 smoothly rotate, the crank arms 10*c* are provided with balance weights 10*d*.

The block movement mechanism 3 is a mechanism for making the cylinder block 2 move relative to the crankcase 1 and, as shown in FIG. 2 to FIG. 4, is provided with a single control shaft 30, coupling members 31, and actuator 32.

The block movement mechanism 3 according to the present embodiment is configured to move the cylinder block 2 in the cylinder axial direction to make the relative position of the cylinder block 2 with respect to the crankcase 1 in the cylinder axial direction change. By making the cylinder block 2 move relative to the crankcase 1 in the cylinder axial direction, it is possible to change only the volumes of the combustion chambers 7 without changing the top dead center positions of the pistons 21. By changing only the volumes of the combustion chambers 7 without changing the top dead center positions of the pistons 21 in this way, it is possible to change the mechanical compression ratio of the internal combustion engine 100. Therefore, the block movement mechanism 3 according to the present embodiment functions as a variable compression ratio mechanism of the internal combustion engine 100. Note that the "mechanical compression ratio" is a compression rate determined mechanically from the stroke volume of a piston 21 and volume of a combustion chamber 7 at the time of a compression stroke and is expressed by (combustion chamber volume+stroke volume)/combustion chamber volume.

The control shaft 30 extends parallel to the crankshaft 10 and is supported by two sets of control bearings 12 (see FIG. 2) provided at the crankcase 1 to be able to rotate and is provided with a main shaft part 30*a* and eccentric parts 30*b* with an axial center P4 (see FIG. 4) at a position offset by exactly a predetermined amount from the axial center P3 of the main shaft part 30*a* (see FIG. 4). Therefore, if making the control shaft 30 rotate once, the axial center P4 of the eccentric parts 30*b* will rotate once about the axial center P3 of the main shaft part 30*a*. In the present embodiment, one eccentric part 30*b* each is provided at one end side and the other end side in the block long direction. As shown in FIG. 2 and FIG. 3, in the present embodiment, one eccentric part 30*b* each is provided at one end side and the other end side in the block long direction.

The coupling members 31 are members for connecting the eccentric parts 30*b* of the control shaft 30 and the cylinder block 2. The coupling members 31 have one end parts at the lower sides in the cylinder axial direction (oil pan 6 side) attached to the eccentric parts 30*b* of the control shaft 30 and have the other end parts at the upper sides in the cylinder axial direction (cylinder head 5 side) attached to the connecting pins 33 supported by the cylinder block 2. As shown in FIG. 2 and FIG. 3, in the present embodiment, two coupling members 31 connect the eccentric part 30*b* at one end side in the block long direction with the cylinder block 2 and the eccentric part 30*b* of the other end side in the block long direction with the cylinder block 2.

Note that in the present embodiment, the control shaft 30 is made a so-called crank shape, but it is also possible to fasten eccentric cams with an axial center offset from the axial center P3 of the main shaft part 30*a* at the outer circumference of the main shaft part 30*a* and to attach one end parts of the coupling members 31 to the outer circumferences of the eccentric cams.

The connecting pins 33 are supported by support parts 23 provided at the side surface of the cylinder block 2 at one end side in the short direction (direction perpendicularly intersecting block long direction and cylinder axial direction, below, referred to as the "block short direction"). As shown in FIG. 2 and FIG. 3, in the present embodiment, one each support part 23 is provided at one end and the other end side of the block long direction so as to correspond to the eccentric part 30*b*.

The actuator 32 is a drive device for giving a drive torque to the control shaft 30 to make the control shaft 30 rotate in two directions within a predetermined range of rotational angle. In the present embodiment, an electric motor is used as the actuator 32.

In this way, when viewing the internal combustion engine 100 from the axial direction of the crankshaft 10 substantially matching the block long direction, the block movement mechanism 3 is arranged at only one side of the left and right of the internal combustion engine 100 (one end side of block short direction in the present embodiment) and is configured to make the cylinder block 2 move relative to the crankcase 1.

The guide mechanism 4 is a mechanism for keeping the cylinder block 2 from tilting in a direction different from the direction of movement and is provided with guide walls 40, support members 41, and pushing members 42.

The guide walls 40 are walls provided at the crankcase 1 so as to face side surfaces of the cylinder block 2 and are arranged around the cylinder block 2 at predetermined clearances from the side surfaces of the cylinder block 2. Note that, in the following explanation, when differentiation is particularly necessary, the guide wall 40 at one end side of the internal combustion engine 100 in the block short direction will be referred to as the "guide wall 40*a*" and the guide wall 40 at the other end side of the block short direction will be referred to as the "guide wall 40*b*".

The support members 41 are members for supporting the side surface of the cylinder block 2 at one end side in the block short direction. As shown in FIG. 4, the support members 41 are fastened to the guide wall 40*a* so that the abutting surfaces 411 formed at one ends contact the side surface of the cylinder block 2 at one end side in the block short direction. Further, as shown in FIG. 2 and FIG. 3, in the present embodiment, four support members 41 are attached to the guide wall 40*a*. More specifically, two support members 41 each are provided at one end side and the other end side of the guide wall 40*a* in the block long direction at the upper side and lower side in the cylinder axial direction.

The pushing members 42 are members for pushing the side surface of the cylinder block 2 at the other end side in the block short direction toward one end side in the block short direction. As shown in FIG. 4, each pushing member 42 according to the present embodiment is provided with a body 421 provided with an open part, an abutting plate 422 attached to the open part of the body 421 to be able to move in two directions in the block short direction, and a spring 423 housed inside the body 421 and imparting to the abutting plate 422 a pushing force constantly pushing the abutting plate 422 toward one end side in the block short direction. The pushing members 42 are fastened to the guide wall 40*b* so as to be able to push the side surface of the cylinder block 2 at the other end side in the block short direction toward the one end side of the block short direction by the abutting plates 422. As shown in FIG. 2 and FIG. 3, in the present embodiment, four pushing members 42 are attached to the guide walls 40*b*. More specifically, two pushing members 42 each are provided at one end side and the other end side of the guide wall 40*b* in the block long direction at the upper side and lower side in the cylinder axial direction.

In this way, in the present embodiment, by supporting the side surface of the cylinder block 2 at one end side of the internal combustion engine 100 in the block short direction by the support members 41 while pushing the side surface of the cylinder block at the other end side in the block short direction by the pushing members 42, when moving the cylinder block 2 in the cylinder axial direction, the cylinder block 2 is kept from tilting in a direction different from the cylinder axial direction. Further, the cylinder block 2 is kept from tilting in a direction different from the cylinder axial direction due to vibration generated during operation of the internal combustion engine 100.

Next, referring to FIG. 5 and FIG. 6, the operation of the block movement mechanism 3 will be explained.

Figure 5:
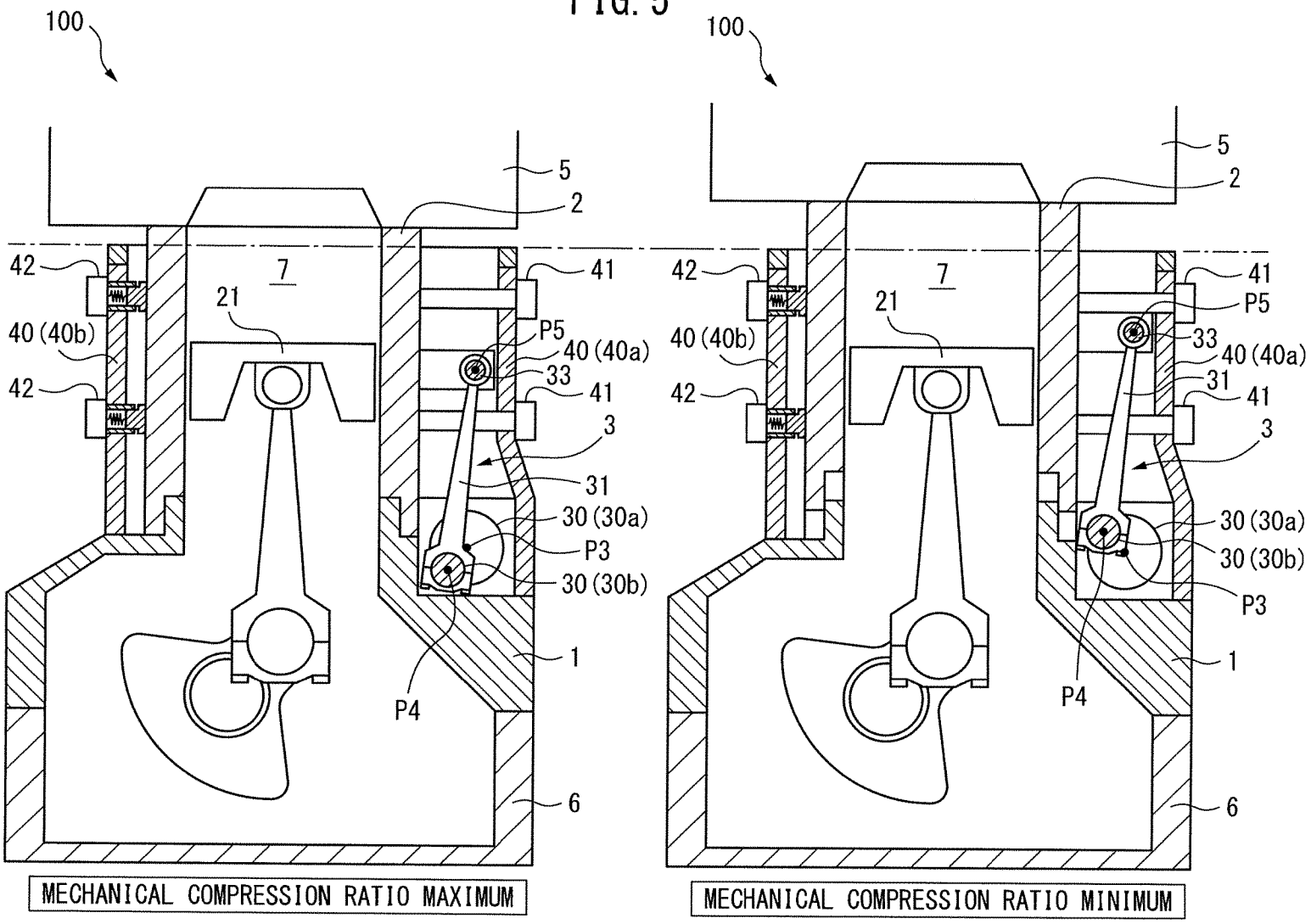
FIG. 5 is a view explaining the operation of a block movement mechanism.

FIG. 5 is a view comparing an internal combustion engine 100 in the state where, due to the block movement mechanism 3, the volumes of the combustion chambers 7 when the pistons 21 are positioned at compression top dead center are made the minimum, that is, the state where the mechanical compression ratio is made maximum, and an internal combustion engine 100 in the state where the control shaft 30 is made to rotate clockwise from that state by exactly a predetermined rotational angle and the volumes of the combustion chambers 7 when the pistons 21 are positioned at compression top dead center are made the maximum, that is, the state where the mechanical compression ratio is made the minimum.

Figure 6:
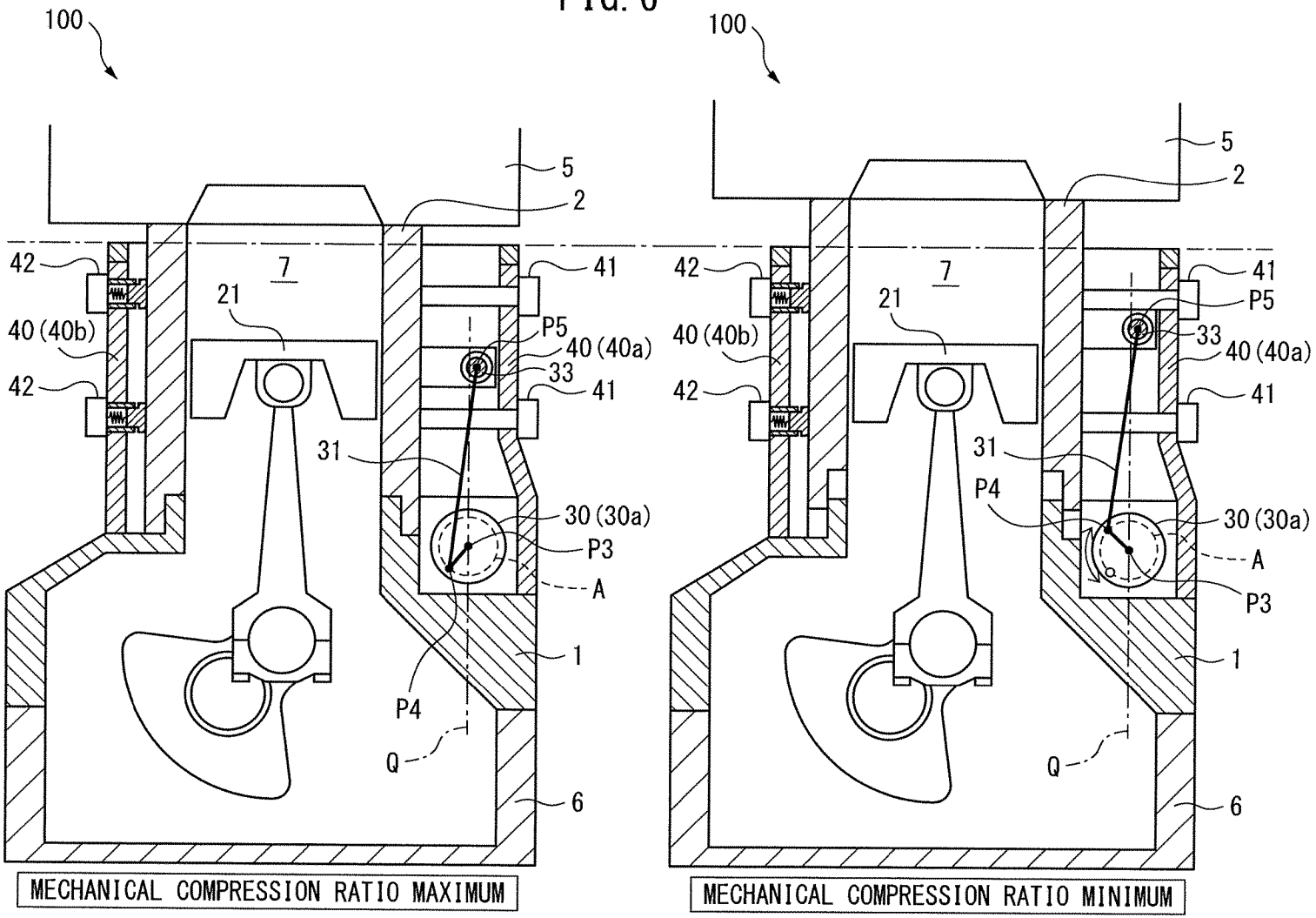
FIG. 6 is a view explaining the operation of the block movement mechanism and schematically shows the block movement mechanism.

FIG. 6, in the same way as FIG. 5, is a view comparing an internal combustion engine 100 in the state where the mechanical compression ratio is made maximum and an internal combustion engine 100 in the state where the mechanical compression ratio is made minimum, but to facilitate understanding of the invention, the block movement mechanism 3 is schematically shown. Note that in FIG. 6, the broken line A shows the path of the axial center P4 of the eccentric parts 30*b* when making the control shaft 30 rotate by one turn. Further, P5 is the axial center of the connecting pins 33.

As shown in FIG. 6, in the present embodiment, when dividing the path A of the axial center P4 of the eccentric parts 30*b* into two semicircular regions by a parallel line Q passing through the axial center P3 of the main shaft part 30*a* and parallel with the cylinder axial direction, the actuator 32 is used to make the control shaft 30 rotate in the two rotational directions so that the axial center P4 moves in the two rotational directions within the range of either semicircular region (in the present embodiment, the semicircular region at the left side in the figure).

Further, the block movement mechanism 3 is configured so that the axial center P4 of the eccentric parts 30*b* is positioned at the lower side in the cylinder axial direction (oil pan 6 side) when in the state at the left side in the figure making the mechanical compression ratio maximum compared with the state at the right side in the figure making the mechanical compression ratio minimum.

For this reason, for example, if using the actuator 32 to make the control shaft 30 rotate clockwise from the state at the left side in the figure of the maximum mechanical compression ratio, the axial center P4 of the eccentric parts 30*b* moves over the path A toward the upper side in the cylinder axial direction (cylinder head 5 side). Due to this, the connecting pins 33 are pushed up straight toward the upper side in the cylinder axial direction through the coupling members 31 connected with the eccentric parts 30*b*, so the cylinder block 2 is pushed up to the upper side in the cylinder axial direction relative to the crankcase 1. As a result, the volumes of the combustion chambers 7 when the pistons 21 are positioned at top dead center of compression gradually increase and the mechanical compression ratio gradually decreases.

On the other hand, for example, if using the actuator 32 to make the control shaft 30 rotate counterclockwise from the state at the right side in the figure of the minimum mechanical compression ratio, the axial center P4 of the eccentric parts 30*b* moves over the path A toward the lower side in the cylinder axial direction. Due to this, the connecting pins 33 are pulled down straight toward the lower side in the cylinder axial direction through the coupling members 31 connected with the eccentric parts 30*b*, so the cylinder block 2 is pulled down to the lower side in the cylinder axial direction relative to the crankcase 1. As a result, the volumes of the combustion chambers 7 when the pistons 21 are positioned at top dead center of compression gradually decrease and the mechanical compression ratio gradually increases.

In this way, the block movement mechanism 3 according to the present embodiment makes a control shaft 30 provided with a main shaft part 30*a* and eccentric parts 30*b* rotate so as to make the axial center P4 of the eccentric parts 30*b* swing about the axial center P3 of the main shaft part 30*a* up and down in the cylinder axial direction and to make the cylinder block 2 move up and down in the cylinder axial direction by the coupling members 31 connected with the eccentric parts 30*b*.

In this regard, in the present embodiment, by just providing such a block movement mechanism 3 at one side of the internal combustion engine 100, it is possible to suppress enlargement of the internal combustion engine 100 and suppress an increase in weight. However, if providing the block movement mechanism 3 at just one side of the internal combustion engine 100, compared with when providing block movement mechanisms 3 at both sides of the internal combustion engine 100, there is the problem that a block rotating force trying to make the cylinder block 2 rotate in a certain rotational direction will be applied during operation of the internal combustion engine 100. Below, this problem will be explained with reference to FIG. 7.

Figure 7:
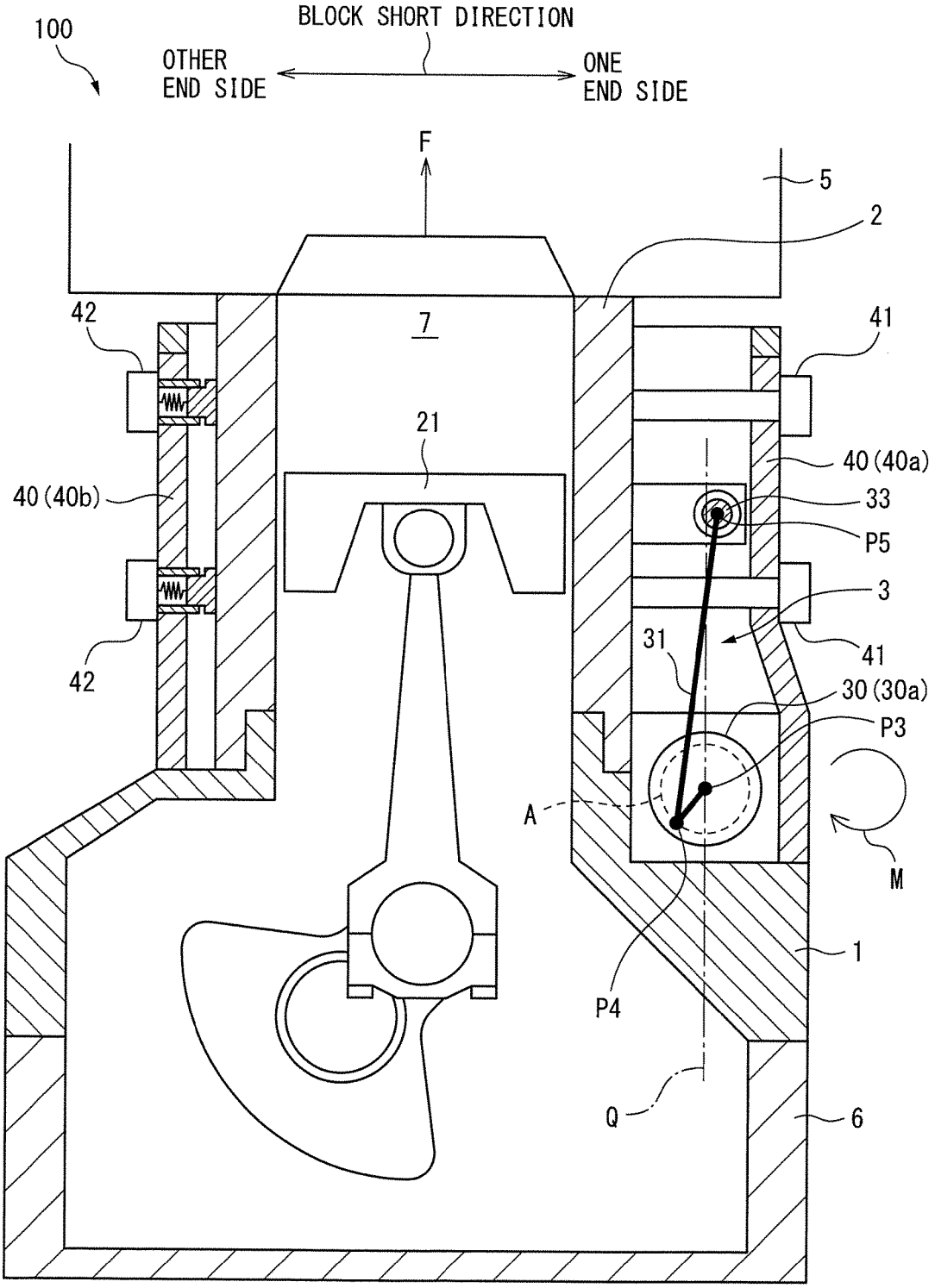
FIG. 7 is a view explaining the problem point in the case of providing a block movement mechanism at only one side of an internal combustion engine.

FIG. 7 is a view for explaining the problem when providing the block movement mechanism 3 at just one side of the internal combustion engine 100 (in this example, one end side in the block short direction). Note that in FIG. 7, to facilitate understanding of the invention, the block movement mechanism 3 is shown schematically.

During operation of the internal combustion engine 100, combustion occurs in the combustion chambers 7 of the cylinders 20, so as shown in FIG. 7, the cylinder head 5 is acted on by an upward combustion load F in the figure. At this time, if, as in the present embodiment, arranging the control shaft 30 at just one side of the internal combustion engine 100 and connecting the control shaft 30 and the cylinder block 2 by the coupling members 31, the combustion load F acting on the cylinder head 5 causes a block rotating force trying to make the cylinder block 2 rotate clockwise in the figure about the control shaft 30. That is, a moment M in the clockwise direction in the figure occurs around the axial center P3 of the main shaft part 30*a*.

Here, even if providing block movement mechanisms 3 at the two sides of the internal combustion engine 100, for example, at one end side and the other end side in the block short direction, a block rotating force will be generated trying to make the cylinder block 2 rotate clockwise about the control shaft 30 arranged along the side surface of the cylinder block 2 at one end side of the internal combustion engine 100 in the block short direction. Further, conversely to this, a block rotating force will be generated trying to make the cylinder block 2 rotate counterclockwise about the control shaft 30 arranged along the side surface of the cylinder block 2 at the other end side of the internal combustion engine 100 in the block short direction. For this reason, the block rotating force trying to make the cylinder block 2 rotate clockwise and the block rotating force trying to make it rotate counterclockwise become balanced and are cancelled out, so in appearance, no block rotating force is generated at the cylinder block 2.

However, if just providing the block movement mechanism 3 at one side of the internal combustion engine 100, block rotating forces will not cancel each other out like in the case of providing them at the two sides. For this reason, when providing the block movement mechanism 3 at just one side of the internal combustion engine 100, a block rotating force trying to make the cylinder block 2 rotate in a certain rotational direction is applied to the cylinder block 2 during operation of the internal combustion engine. This block rotating force acts on the support members 41 and pushing members 42.

Figure 8:
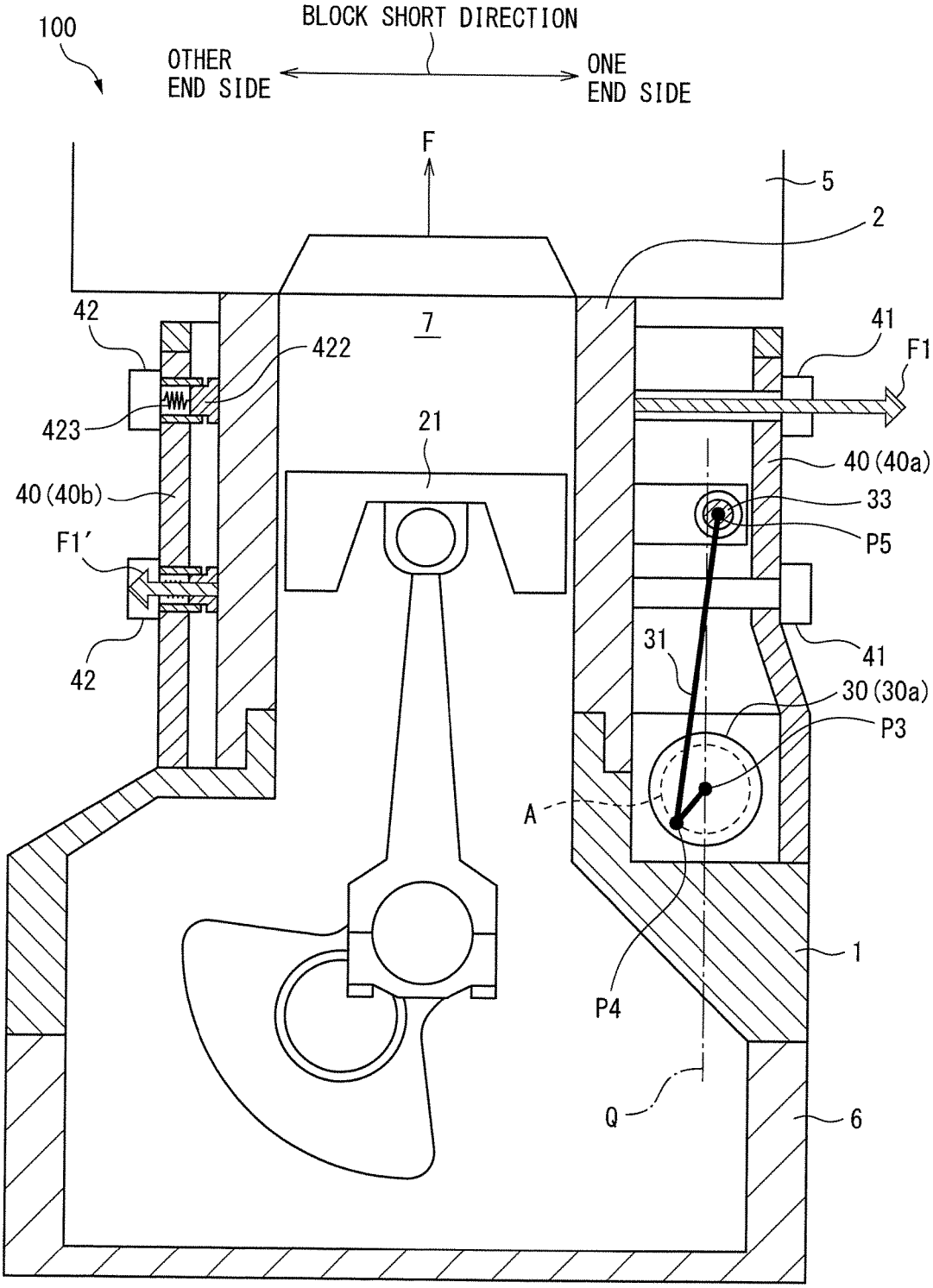
FIG. 8 is a view showing the forces acting on support members and pushing members due to the block rotating force by arrows.

FIG. 8 is a view showing the forces acting on the support members 41 and pushing members 42 due to the block rotating force by arrows.

In the example shown in FIG. 8, the cylinder block 2 is acted on by a block rotating force trying to make the cylinder block 2 turn in the clockwise direction. For this reason, as shown in FIG. 8, the support members 41 at one end side of the block short direction where the block movement mechanism 3 is provided, mainly the upper side support members 42, are acted on by the block rotating force F1 due to the combustion load F. Further, the pushing members 42 at the other end side of the block short direction, mainly the lower side pushing members 42, are acted on by the block rotating force F1' smaller than the block rotating force F1.

Here, in the present embodiment, as shown in FIG. 8, the side surface of the cylinder block 2 at one end side in the block short direction upon which the block rotating force F1 acts is supported by the support members 41 and the side surface of the cylinder block 2 at the other end side in the block short direction upon which the block rotating force F1' smaller than the block rotating force F1 acts is pushed by the pushing members 42. Below, the reason will be explained.

As explained above, in the present embodiment, by supporting the side surface of the cylinder block 2 at one side of the internal combustion engine 100 by the support members 41 while pushing the side surface of the cylinder block 2 at the opposite side by the pushing members 42, the cylinder block 2 is kept from tilting in a direction different from the cylinder axial direction.

At this time, the support members 41 are fastened to the guide wall 40*a* to be unable to move, so the pushing members 42 push the abutting plates 422 against the side surface of the cylinder block 2 by the pushing force of the springs 423. For this reason, if a force larger than the pushing force of the springs 423 is applied from the cylinder block 2 side, the cylinder block 2 is liable to tilt to the pushing member 42 side. To prevent this, it is sufficient to enlarge the pushing force of the springs 423, but the more the pushing force of the springs 423 is enlarged, the greater the force by which the pushing members 42 and the support members 41 clamp the cylinder block 2. For this reason, when moving the cylinder block 2, the resistance in the cylinder axial direction occurring between the support members 41 and pushing members 42 and the cylinder block (below, referred to as the "sliding resistance") ends up increasing.

If the sliding resistance increases, the load when making the cylinder block 2 move in the cylinder axial direction, that is, the drive torque for making the control shaft 30 rotate, increases. For this reason, for example, when making the actuator 32 an electric motor, the power consumption increases and as a result deterioration of the fuel efficiency is invited. Further, it is also necessary to raise the maximum drive torque of the actuator 32, so larger size and larger required capacity of the actuator 32 are invited and as a result enlargement and increase of weight of the internal combustion engine 100 are invited.

Therefore, in the present embodiment, as explained above, one end side in the block short direction upon which the block rotating force F1 acts is supported by the support members 41 while the other end side in the block short direction upon which a block rotating force F1' smaller than the block rotating force F1 acts is pushed by the pushing members 42.

Due to this, compared with when pushing one end side of the block short direction upon which a large block rotating force F1 caused by the combustion load F acts by the pushing members 42, it is possible to reduce the pushing force of the springs 423 of the pushing members 42. Accordingly, it is possible to reduce the sliding resistance when moving the cylinder block 2 in the cylinder axial direction. As a result, deterioration of the fuel efficiency and larger size and larger required capacity of the actuator can be suppressed. For this reason, enlargement and increase in weight of the internal combustion engine 100 can be further suppressed.

In this way, the support members 41 and pushing members 42 are acted on by the block rotating forces F1 and F1' due to the combustion load F, but in addition to this, forces in the block short direction due to the tilt of the coupling members 31 of the block movement mechanism 3 when moving the cylinder block 2 in the cylinder axial direction (below, referred to as "movement mechanism thrust forces") act. Below, referring to FIG. 9, this movement mechanism thrust forces will be explained.

Figure 9:
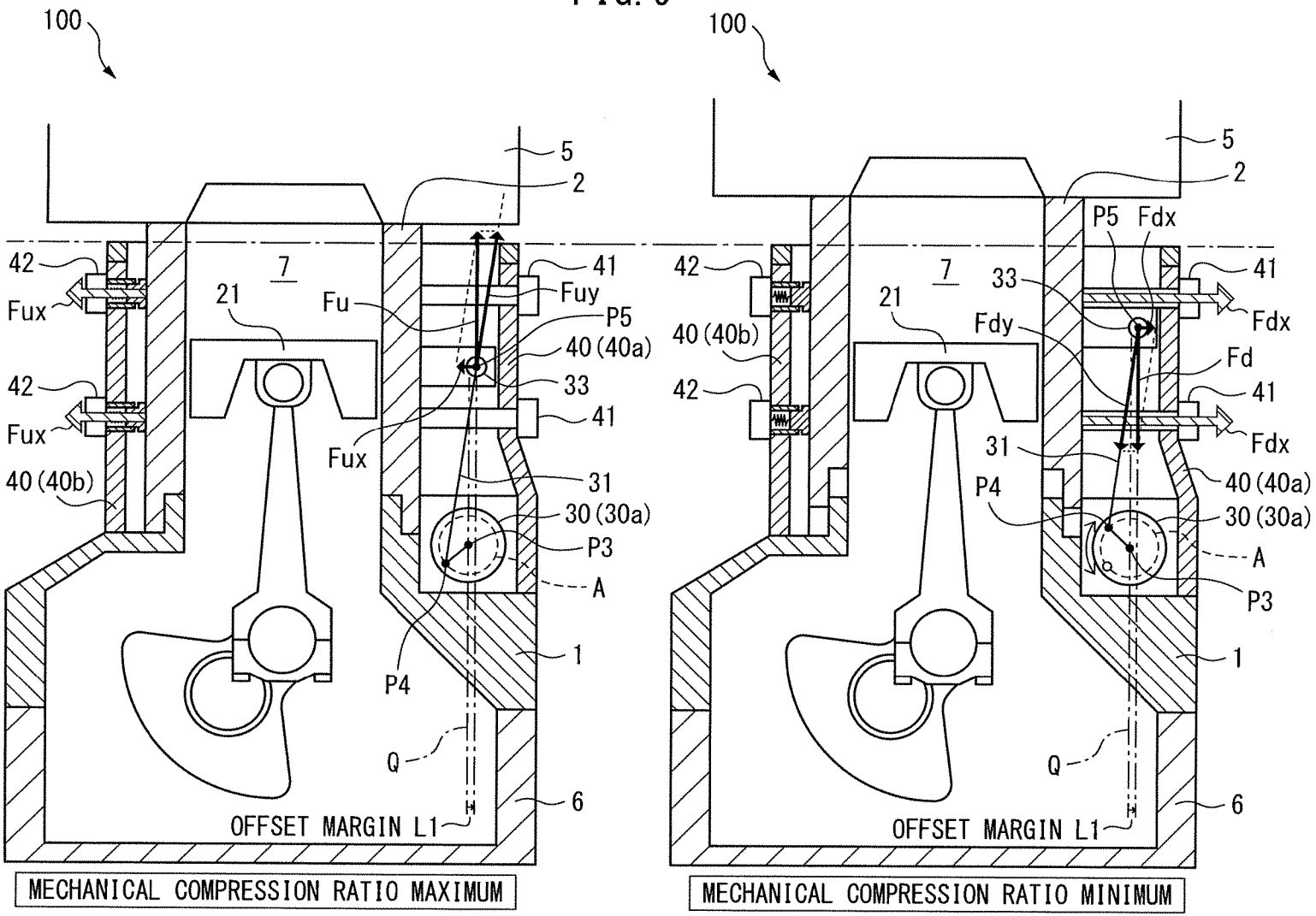
FIG. 9 is a view showing the movement mechanism thrust forces acting on support members and pushing members by arrows.

FIG. 9 is a view showing the movement mechanism thrust forces acting on the support members 41 and pushing members 42 by arrows. Note that FIG. 9 shows in comparison the internal combustion engine 100 in the state when making the mechanical compression ratio maximum like in FIG. 6 and the internal combustion engine 100 in the state when making the mechanical compression ratio minimum and schematically shows the block movement mechanism 3.

As shown in FIG. 9, in the present embodiment, one end parts of the coupling members 31 are attached to the eccentric parts 30*b* and the other end parts are attached to the connecting pins 33 so that the axial center P5 of the connecting pins 33 is positioned at the guide wall 40*a* side from the axial center P4 of the eccentric parts 30*b* (that is, outside of the internal combustion engine 100). That is, the coupling members 31 are tilted so that the other end parts of the coupling members 31 are positioned at the guide wall 40*a* side from the one end parts. Specifically, in the present embodiment, one end parts of the coupling members 31 are attached to the eccentric parts 30*b* and the other end parts are connected to the connecting pins 33 so that the axial center P5 of the connecting pins 33 is arranged at a position separated by exactly a predetermined offset margin L1 from the parallel line Q to the other end side in the block short direction. For convenience in the following explanation, tilting the coupling members 31 so that the other end parts of the coupling members 31 are positioned at the guide wall 40*a* side from the one end parts in this way will be referred to as "tilting the coupling member 31 outward from the block".

Here, as shown in FIG. 9, for example, if making the control shaft 30 rotate clockwise due to the actuator 32 from the state where the mechanical compression ratio is made maximum at the left side in the figure, the connecting pins 33 are acted on by an upper side force Fu in the cylinder axial direction. If tilting the coupling member 31 outward from the block, this force Fu is divided into a component force Fux of the thrust direction toward the other end side in the block short direction and a component force Fuy of the tilt direction of the coupling members 31 acting from the coupling members 31 to the connecting pins 33.

Therefore, if tilting the coupling member 31 outward, when making the cylinder block 2 move upward in the cylinder axial direction, the component force Fux of the thrust direction acting from the block movement mechanism 3 to the cylinder block 2 toward the other end side in this block short direction acts on the pushing members 42 as the movement mechanism thrust force Fux. In the following explanation, this movement mechanism thrust force Fux toward the other end side of the block short direction will be referred to as the "movement mechanism reverse thrust force Fux".

On the other hand, for example, if making the control shaft 30 rotate counterclockwise due to the actuator 32 from the state where the mechanical compression ratio is made minimum at the right side in the figure, the connecting pins 33 are acted on by a lower side force Fd in the cylinder axial direction. If tilting the coupling member 31 outward from the block, this force Fd is divided into a component force Fdx of the thrust direction toward the one end side in the block short direction and a component force Fdy of the tilt direction of the coupling members 31 acting from the coupling members 31 to the connecting pins 33.

Therefore, if tilting the coupling member 31 outward from the block, when making the cylinder block 2 move downward in the cylinder axial direction, the component force Fdx of the thrust direction acting from the block movement mechanism 3 to the cylinder block 2 toward the one end side in the block short direction acts on the support members 41 as the movement mechanism thrust force Fdx. In the following explanation, this movement mechanism thrust force Fdx toward the one end side of the block short direction will be referred to as the "movement mechanism forward thrust force Fdx".

When tilting the coupling members 31 outward in this way, a movement mechanism reverse thrust force Fux acts on the pushing members 42 when making the cylinder block 2 move upward in the cylinder axial direction while a movement mechanism forward thrust force Fdx acts on the support members 41 when making the cylinder block 2 move downward in the cylinder axial direction.

As explained above, during operation of the internal combustion engine 100, combustion occurs in the combustion chambers 7 of the cylinders 20, so the cylinder head 5 is acted on by an upward combustion load F in the figure. For this reason, when making the cylinder block 2 move downward in the cylinder axial direction, it is necessary to make the cylinder block 2 move against the combustion load F, so the force required for making the cylinder block 2 move becomes larger. That is, if comparing the upward force Fu in the cylinder axial direction and the downward force Fd in the cylinder axial direction acting on the connecting pins 33 when making the cylinder block 2 move up and down by the same amounts of movement, the downward force Fd in the cylinder axial direction becomes larger. Therefore, if comparing the movement mechanism reverse thrust force Fux and the movement mechanism forward thrust force Fdx, the movement mechanism forward thrust force Fdx becomes larger.

In this way, by tilting the coupling member 31 outward from the block, a movement mechanism reverse thrust force Fux becoming relatively smaller in magnitude of force in the movement mechanism thrust generated when moving the cylinder block 2 due to the tilt of the coupling members 31 can be made to act on the pushing members 42. For this reason, compared with the case where the pushing members 42 are acted on by the movement mechanism forward thrust force Fdx, it is possible to reduce the pushing force of the springs 423 of the pushing members 42. Accordingly, it is possible to reduce the sliding resistance when moving the cylinder block 2 in the cylinder axial direction. As a result, it is possible to suppress deterioration of the fuel economy and enlargement and increase of required capacity of the actuator 32. For this reason, it is possible to further suppress the enlargement and increase in weight of the internal combustion engine 100.

Further, to reduce the sliding resistance when moving the cylinder block 2 in the cylinder axial direction, it is effective to reduce the magnitude itself of the block rotating force F1 due to the combustion load F. Due to this, the block rotating force F1' can also be made smaller, so the biasing forces of the springs 423 of the pushing members 42 can be made smaller. Below, referring to FIG. 10, the method of reducing the magnitude itself of the block rotating force F1 will be explained.

Figure 10:
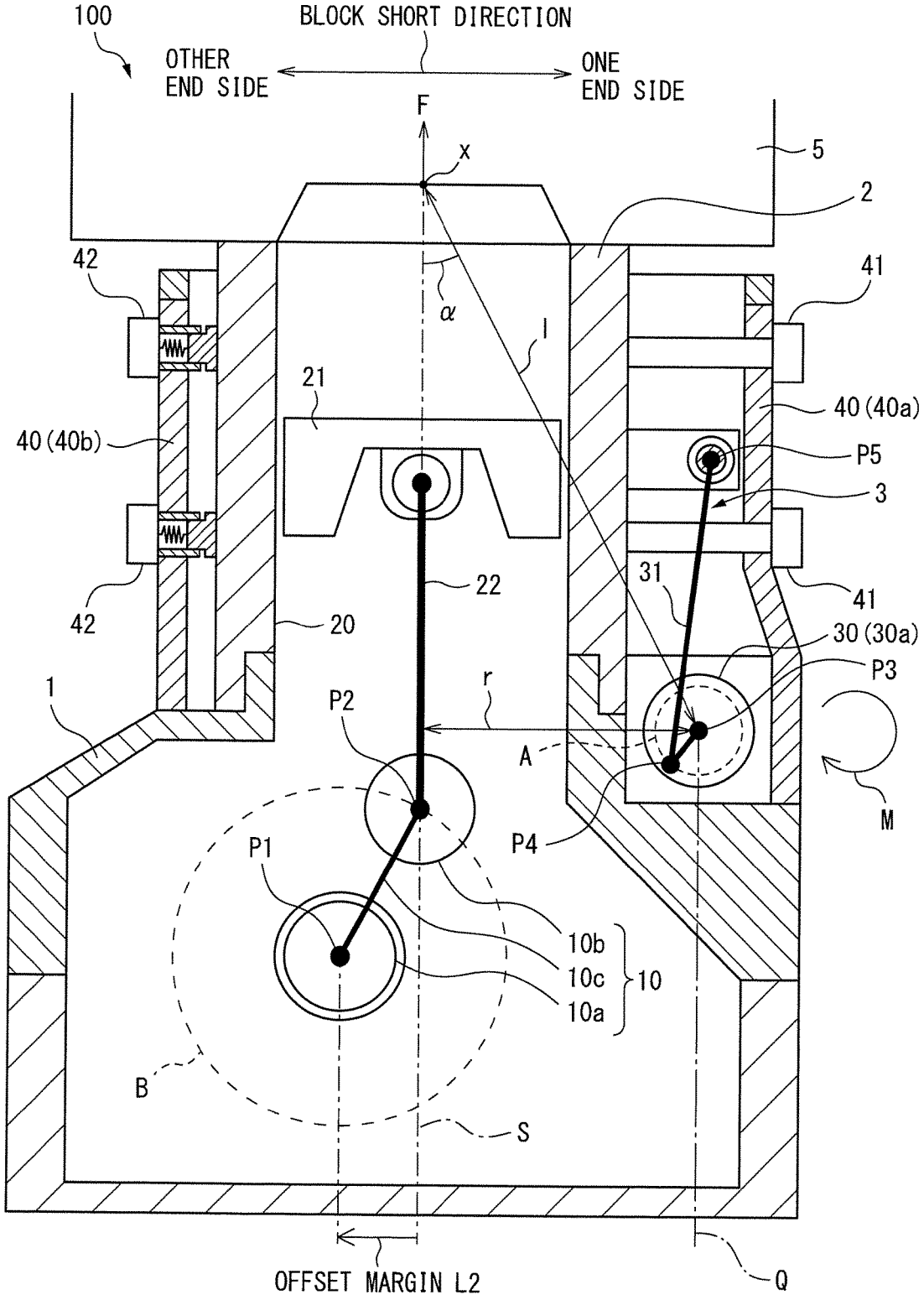
FIG. 10 is a view for explaining the method of reducing the magnitude of the block rotating force itself.

FIG. 10 is a view for explaining the method of reducing the magnitude itself of the block rotating force F1. Note that in FIG. 10, to facilitate understanding of the invention, the piston crank mechanism comprised of the pistons 21, connecting rods 22, and crankshaft 10 and the block movement mechanism 3 are schematically shown. Further, the broken line B of FIG. 10 is the path of the axial center P2 of the crank pins 10*b* when the crankshaft 10 is made to rotate by 1 turn.

As shown in FIG. 10, when providing the block movement mechanism 3 at only one side of the internal combustion engine 100, the size of the moment M about the axial center P3 caused by the combustion load F is expressed by the following formula (1) where the length of the line segment connecting the axial center P3 and the operating point X of the combustion load F is defined as "l", the angle formed by that line segment and the operating line of the combustion load F (that is, the cylinder center axis S) is defined as a, and the moment arm is defined as "r".

$$M=r\times F \tag{1}$$

where, $r=l\times\sin\alpha$

The larger the moment M, the larger the block rotating force F1. Therefore, to make the block rotating force F1 smaller, the moment M has to be made smaller. Here, as will be understood from formula (1), the moment M becomes smaller the shorter the moment arm r even if the combustion load F is the same in magnitude. Therefore, to make the moment M smaller, it is effective to shorten the moment arm r as much as possible.

Therefore, in the present embodiment, as shown in FIG. 10, the crankcase 1 is used to support the crankshaft 10 so that the axial center P1 of the crank journals 10*a* is arranged at a position separated from the cylinder center axis S by exactly a predetermined offset margin L2 to the other end side of the block short direction. Still further, the block movement mechanism 3 is arranged at one end side in the block short direction becoming the opposite side to the direction in which the axial center P1 of the crank journals 10*a* is separated from the cylinder center axis S by exactly the offset margin L2 (below, referred to as the "crank offset direction").

The crankshaft 10 and the control shaft 30 of the block movement mechanism 3 have to be arranged so that the path B of the axial center P2 of the crank pins 10*b* and the path A of the axial center P4 of the eccentric parts 30*b* do not interfere with each other. For this reason, like in the present embodiment, by arranging the axial center P1 of the crank journals 10*a* at a position separated from the cylinder center axis S by exactly a predetermined offset margin L2 at the other end side of the block short direction and by arranging the block movement mechanism 3 at the one end side of the block short direction forming the opposite side to the crank offset direction, it is possible to make the path B of the axial center P2 of the crank pins 10*b* move in the crank offset direction by exactly the amount of the offset margin L2. Therefore, it is possible to create space for arranging the block movement mechanism 3 in the crank offset direction by exactly the amount of the offset margin L2 and possible to make the path A of the axial center P4 of the eccentric parts 30*b* move in the crank offset direction by exactly the amount of the offset margin L2.

For this reason, compared with the case of arranging the axial center P1 of the crank journals 10*a* on the cylinder center axis S, it is possible to shorten the moment arm r by exactly the amount of the offset margin L2.

Further, when arranging the axial center P1 of the crank journals 10*a* at a position separated from the cylinder center axis S by exactly a predetermined offset margin L2 at the other end side of the block short direction, the moment arm r becomes longer by exactly the amount of the offset margin L when arranging the block movement mechanism 3 at the opposite side from the present embodiment, that is, when arranging the block movement mechanism 3 at the other end side of the block short direction forming as the crank offset direction. Therefore, if compared with this, it is possible to shorten the moment arm r by exactly two times the offset margin L2.

In this way, by arranging the axial center P1 of the crank journals 10*a* at a position separated from the cylinder center axis S by exactly a predetermined offset margin L2 at the other end side of the block short direction and arranging the block movement mechanism 3 at the one end side in the block short direction forming the opposite side to the crank offset direction, it is possible to shorten the moment arm r of the moment M about the axial center P3 caused due to the combustion load F.

Therefore, if providing the block movement mechanism 3 at just one side of the internal combustion engine 100, it is possible to reduce the magnitude itself of the block rotating force F1 due to the combustion load F. Due to this, it is possible to reduce the block rotating force F1' as well, so it is possible to further reduce the pushing force of the springs 423 of the pushing members 42. Accordingly, it is possible to further reduce the sliding resistance when making the cylinder block 2 move in the cylinder axial direction. As a result, it is possible to suppress deterioration of the fuel economy or enlargement of the size and increase of the required capacity of the actuator. For this reason, it is possible to further suppress enlargement and increase in weight of the internal combustion engine 100.

Figure 11:
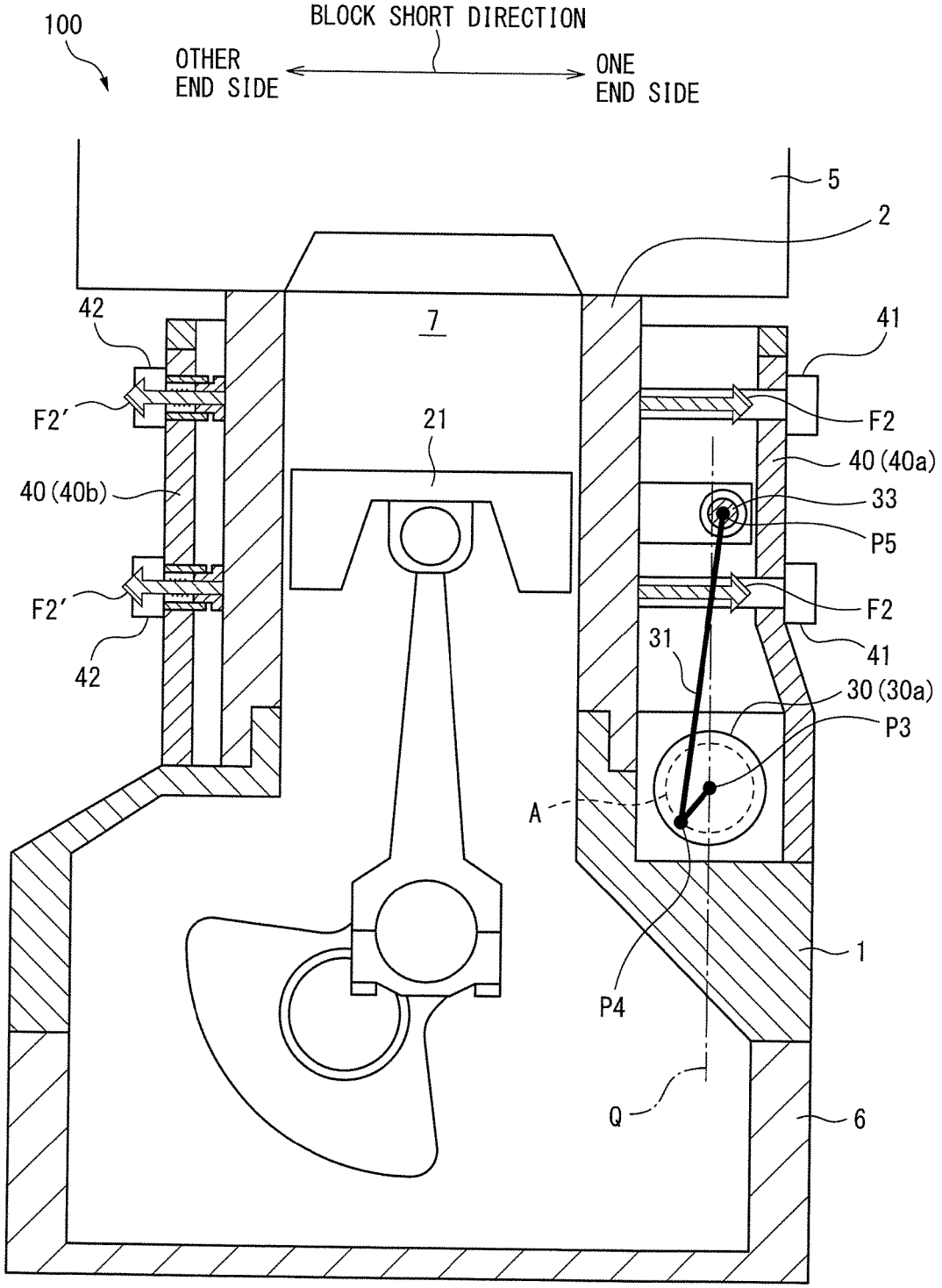
FIG. 11 is a view showing the piston thrust forces acting on support members and pushing members by arrows.

Further, during operation of the internal combustion engine 100, due to the tilt of the connecting rods 22 during reciprocating motion of the pistons 21, the cylinder block 2 is acted on by a piston reverse thrust force F2 pushing the cylinder block 2 to one end side in the block short direction and a piston forward thrust force F2' pushing the cylinder block 2 to the other end side in the block short direction from the pistons 21. For this reason, as shown in FIG. 11, a piston reverse thrust force F2 acts on the support members 41 at one end side in the block short direction, and a piston forward thrust force F2' acts on the pushing members 42 at the other end side in the block short direction.

At this time, by arranging the axial center P1 of the crank journals 10*a* in the crank offset direction from the cylinder center axis S as in the present embodiment, it is possible to make the piston forward thrust force F2' acting on the pushing members 42 smaller than the piston reverse thrust force F2 acting on the support members 41.

Figure 12:
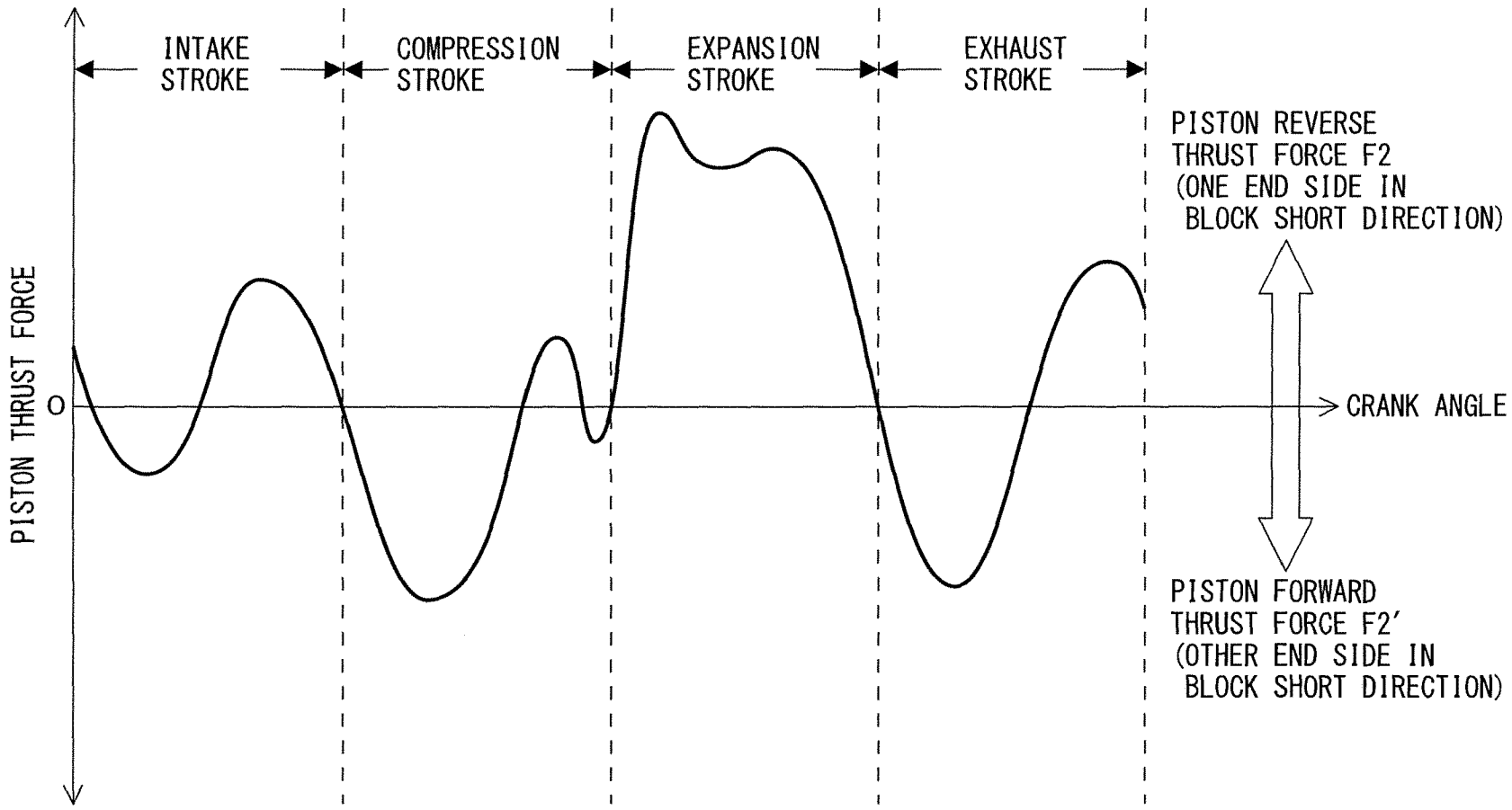
FIG. 12 is a view showing the change of the piston thrust forces in one cycle from a intake stroke to exhaust stroke in the case of arranging the axial center of crank journals in a crank offset direction from the cylinder center axis.

FIG. 12 is a view showing the changes in the piston thrust forces during one cycle from the intake stroke to the exhaust stroke in the case of arranging the axial center P1 of the crank journals 10*a* in the crank offset direction from the cylinder center axis S.

As shown in FIG. 12, by arranging the axial center P1 of the crank journals 10*a* in the crank offset direction from the cylinder center axis S, it is possible to make the piston thrust forces in the expansion stroke, when the combustion pressure acts on the pistons 21 and the piston thrust forces become particularly large, concentrate at one end side in the block short direction. For this reason, it is possible to make the piston forward thrust force F2' acting on the pushing members 42 smaller than the piston reverse thrust forces F2 acting on the support members 41.

For this reason, it is possible to further reduce the biasing forces of the springs 423 of the pushing members 42. Accordingly, it is possible to further reduce the sliding resistance when moving the cylinder block 2 in the cylinder axial direction. As a result, it is possible to suppress deterioration of the fuel economy and enlargement and increase of required capacity of the actuator. For this reason, it is possible to further suppress the enlargement and increase in weight of the internal combustion engine 100.

According to the present embodiment explained above, the internal combustion engine 100 provided with a cylinder block 2 able to move relative to the crankcase 1 is provided with a block movement mechanism 3 arranged at just one side of the left and right of the internal combustion engine 100 when viewing the internal combustion engine 100 from an axial direction of a crankshaft 10 supported at the crankcase 1 to be able to rotate and making the cylinder block 2 move relative to the crankcase 1, support members 41 supporting a side surface of the cylinder block 2, and pushing members 42 pushing the side surface of the cylinder block 2 at the opposite side to the side surface supported by the support members 41.

Further, the block movement mechanism 3 is configured provided with a single control shaft 30 supported by the crankcase 1 and having a main shaft part 30*a* and eccentric parts 30*b* with an axial center P4 at a position offset by a predetermined amount from the axial center P3 of the main shaft part 30*a*, coupling members 31 with one end parts attached to the eccentric parts 30*b* and with the other end parts attached to cylinder block 2 and connecting the control shaft 30 and the cylinder block 2, and an actuator 32 for making the control shaft 30 rotate within a predetermined range of rotation in both directions to make axial center of the eccentric parts 30*b* swing about the axial center of the main shaft part 30*a* in the direction of relative movement of the cylinder block 2. Further, the support members 41 are configured to support the side surface of the cylinder block 2 at the side of arrangement of the block movement mechanism 3, and the pushing members 42 are configured to push the side surface of the cylinder block 2 at the opposite side to the side of arrangement of the block movement mechanism 3.

Due to this, according to the present embodiment, by just making one control shaft 30 rotate, it is possible to make the cylinder block 2 move relative to the crankcase 1 through the coupling members 31. For this reason, it is sufficient to arrange a single control shaft 30 at just one side at the left and right of the internal combustion engine 100 parallel to the crankshaft 10. As a result, the block movement mechanism 3 can be arranged at just one side at the left and right of the internal combustion engine. Therefore, there is no need to provide eccentric shafts at both sides of the internal combustion engine 100 like in the above-mentioned conventional internal combustion engine. Further, there is no need to arrange the drive shaft for making the two eccentric shafts rotate. Therefore, it is possible to suppress enlargement of the internal combustion engine 100 provided with a cylinder block 2 able to move relative to a crankcase 1 and thereby suppress an increase in weight.

Further, when arranging such a configuration of a block movement mechanism 3 at just one side at the left and right of the internal combustion engine 100, a block rotating force F1 trying to make the cylinder block 2 rotate to the block movement mechanism 3 side acts on the cylinder block 2. For this reason, by supporting the side surface of the cylinder block 2 on which such a block rotating force F1 acts by the support members 41 and pushing the side surface at the opposite side by the pushing members 42 like in the present embodiment, it is possible to reduce the pushing force of the springs 423 of the pushing members 42. Therefore, it is possible to reduce the sliding resistance when moving the cylinder block 2, so it is possible to keep the cylinder block 2 from tilting in a direction different from the direction of relative movement while suppressing the load when moving the cylinder block 2.

Further, according to the internal combustion engine 100 according to the present embodiment, the coupling members 31 are attached at one end parts to the eccentric parts 30*b* and at other end parts to the cylinder block 2 so that the other end parts are positioned at the outside of the internal combustion engine 100 from the one end parts.

By tilting the coupling members 31 outward from the block in this way, it is possible to make the movement mechanism reverse thrust force Fux, which becomes relatively smaller in magnitude of force in the movement mechanism thrusts caused when moving the cylinder block 2 due to the tilt of the coupling members 31, act on the pushing members 42. For this reason, compared with the case where a movement mechanism forward thrust force Fdx acts on the pushing members 42, it is possible to reduce the biasing forces of the springs 423 of the pushing members 42. Accordingly, it is possible to reduce the sliding resistance when moving the cylinder block 2 in the cylinder axial direction. As a result, it is possible to suppress deterioration of the fuel economy and enlargement and increase of required capacity of the actuator 32. For this reason, it is possible to further suppress the enlargement and increase in weight of the internal combustion engine 100.

Further, according to the internal combustion engine 100 according to the present embodiment, the crankcase 1 supports the crankshaft 10 so that the axial center P1 of the crank journals 10*a* (axial center of crankshaft 10) is arranged at a position separated from the center axis S of the cylinders 20 formed at the cylinder block 2 by exactly the offset margin L2 (predetermined distance). Further, the block movement mechanism 3 is arranged at the opposite side of the center axis S of the cylinders 20 from the direction of separation of the axial center P1 of the crankshaft 10.

Due to this, for example, compared to when the axial center P1 of the crank journals 10*a* is arranged on the center axis S of the cylinders 20, it is possible to shorten the moment arm r of the moment M about the axial center P3 of the main shaft part 30*a* due to the combustion load F by exactly the amount of the offset margin L2. Therefore, when providing the block movement mechanism 3 at just one side of the cylinder block 2, it is possible to reduce the magnitude itself of the block rotating force F1 due to the combustion load F. Due to this, it is also possible to reduce the block rotating force F1', so it is possible to further reduce the biasing forces of the springs 423 of the pushing members 42. Accordingly, it is possible to further reduce the sliding resistance when moving the cylinder block 2 in the cylinder axial direction. As a result, it is possible to suppress deterioration of the fuel economy and enlargement and increase of required capacity of the actuator 32. For this reason, it is possible to further suppress enlargement and increase of weight of the internal combustion engine 100.

Further, by arranging the axial center P1 of the crank journals 10*a* in the crank offset direction from the cylinder center axis S, it is possible to make the piston thrust forces during the expansion stroke when the combustion pressure acts on the pistons 21 and the piston thrust forces become particularly large concentrate at one end side in the block short direction. For this reason, it is possible to make the piston forward thrust force F2' acting on the pushing members 42 smaller than the piston reverse thrust forces F2 acting on the support members 41.

For this reason, it is possible to further reduce the biasing forces of the springs 423 of the pushing members 42. Accordingly, it is possible to further reduce the sliding resistance when moving the cylinder block 2 in the cylinder axial direction. As a result, it is possible to suppress deterioration of the fuel economy and enlargement and increase of required capacity of the actuator 32. For this reason, it is possible to further suppress the enlargement and increase in weight of the internal combustion engine 100.

Further, the internal combustion engine 100 according to the present embodiment is further provided with guide walls 40 provided at the crankcase 1 so as to cover the surroundings of the side surfaces of the cylinder block 2. Further, a plurality of support members 41 are attached to the guide wall 40*a* separated by predetermined intervals in the direction of relative movement of the cylinder block 2 at the side of arrangement of the block movement mechanism 3. Further, a plurality of pushing members 42*b* are attached separated by predetermined intervals in the direction of relative movement of the cylinder block 2 at the guide wall 40*b* at the opposite side from the side of arrangement of the block movement mechanism 3.

The blocking rotating force trying to make the cylinder block 2 rotate to the block movement mechanism 3 side due to the combustion load F during operation of the internal combustion engine 100, as shown in FIG. 8, differs in forces acting at the upper side and lower side of the direction of relative movement of the cylinder block 2 in accordance with the direction of rotation. For this reason, by providing the guide walls 40 with pluralities of support members 41 and pushing members 42 separated by predetermined intervals in the direction of relative movement of the cylinder block 2, it is possible to effectively receive the block rotating force by the support members 41 and the pushing members 42. For this reason, it is possible to effectively keep the blocking rotating force from acting on the cylinder block 2 and accordingly the cylinder block 2 from tilting in a direction different from the direction of relative movement.

Above, embodiments of the present invention were explained, but the embodiments only show part of the examples of application of the present invention. The technical scope of the present invention is not limited to the above specific configurations.

For example, in the above embodiments, pushing members 42 configured to push the abutting plates 422 against the side surface of the cylinder block 2 by the biasing forces of springs 423 were used, but the configuration of the pushing members 42 is not limited to such a configuration.

Figure 13:
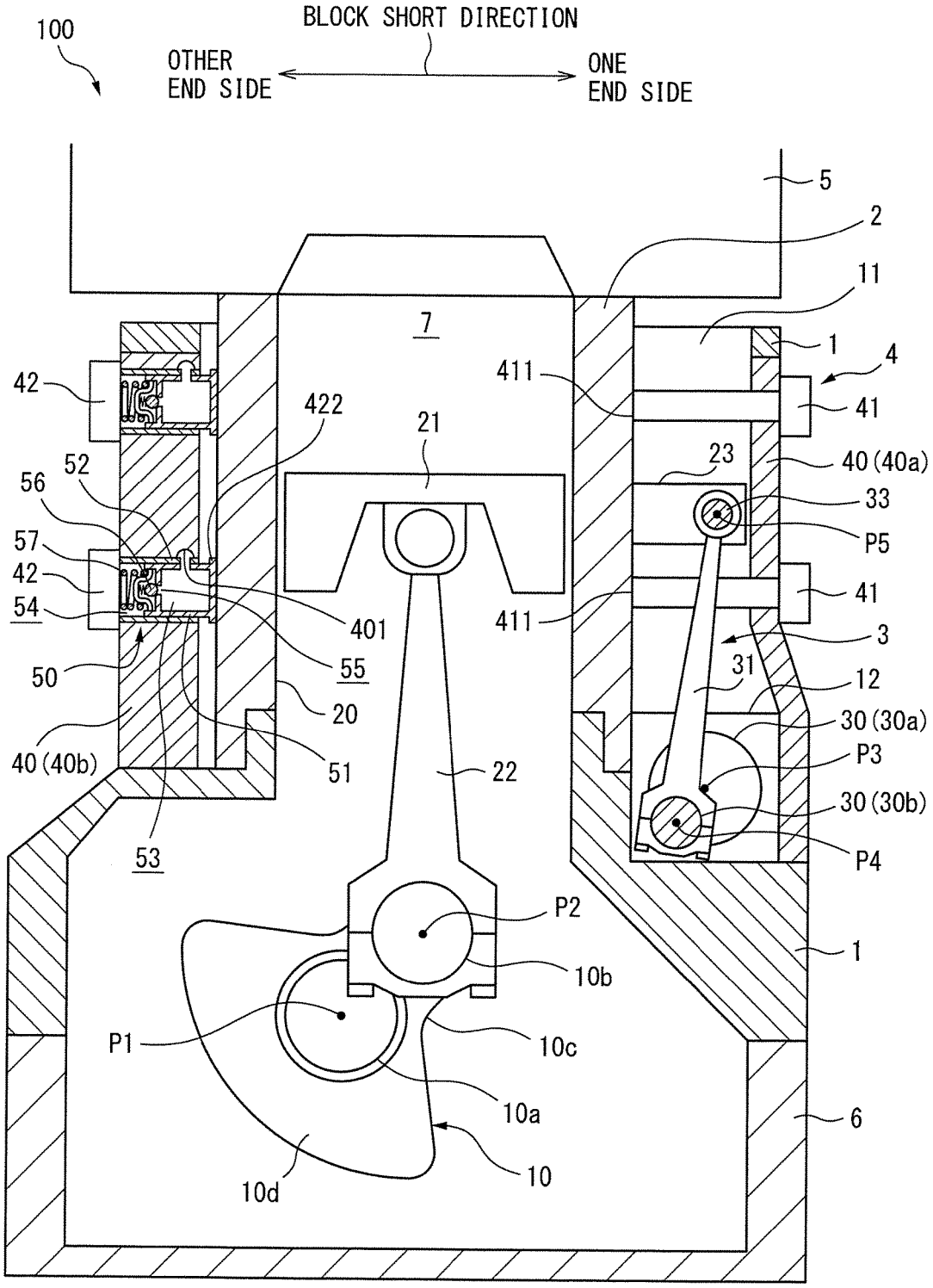
FIG. 13 is a view showing a modification of an internal combustion engine according to one embodiment of the present invention.

For example, as shown in FIG. 13, it is also possible to provide oil paths 401 inside of the guide wall 40*b*, use hydraulic lash adjusters 50 as pushing members 42 to push abutting plates 422 against the side surface of the cylinder block 2, and constantly maintain the clearance between the abutting plates 422 and the side surface of the cylinder block 2 zero.

Each lash adjuster 50 is provided with a plunger 51 formed integrally with the abutting plate 422, a body 52 holding the plunger 51, a first oil pressure chamber 53 formed at the inside of the plunger 51, a second oil pressure chamber 54 formed inside the body 52, a check ball 56 sealing a communicating path 55 connecting the first oil pressure chamber 53 and the second oil pressure chamber 54, and a spring 57 arranged inside the second oil pressure chamber 54 and constantly pushing the plunger 51 against the cylinder block 2 side (one end side of block short direction). When the lash adjuster 50 is not subject to pushing force from the cylinder block 2 side, the plunger 51 is pushed up by the spring force of the spring 57 whereby the abutting plate 422 is made to abut against the side surface of the cylinder block 2 and the clearance between the abutting plate 422 and the side surface of the cylinder block 2 is constantly maintained at zero. On the other hand, if a pushing force from the cylinder block 2 side is applied to the abutting plate 422, the plunger 51 is pushed down and the check ball 56 seals the second oil pressure chamber 54 resulting in a higher pressure. As a result, due to the oil pressure of the second oil pressure chamber 54, the position of the plunger 51 is fixed at a predetermined position and the abutting plate 422 is pushed against the side surface of the cylinder block 2.

Figure 14:
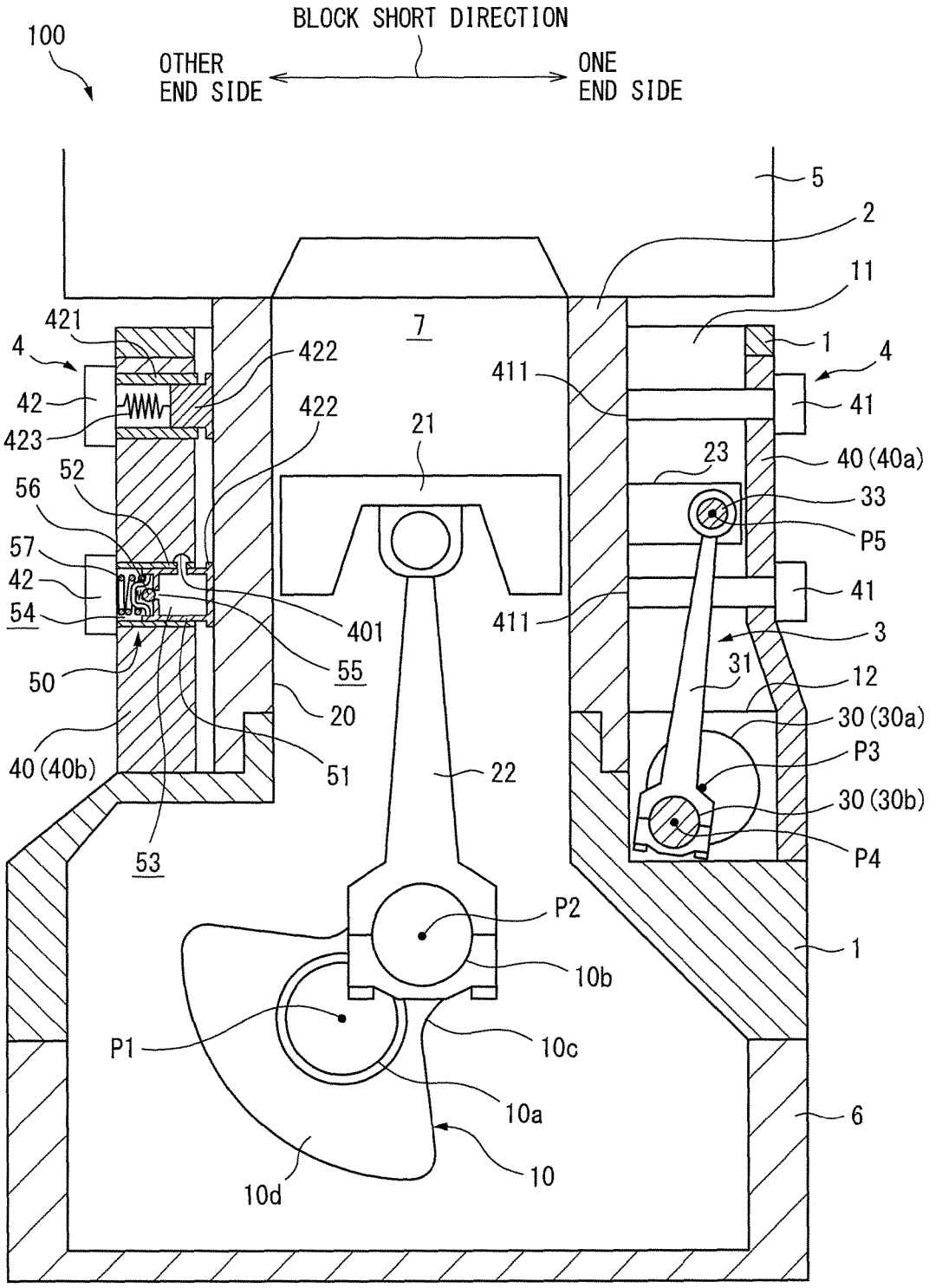
FIG. 14 is a view showing another modification of an internal combustion engine according to one embodiment of the present invention.

Further, as shown in FIG. 14, it is also possible to configure part of the pushing members 42 to push the abutting plates 422 against the side surface of the cylinder block 2 by the biasing forces of the springs 423 and to configure the remaining part of the pushing members 42 to push the abutting plates 422 against the side surface of the cylinder block 2 using a hydraulic lash adjuster 50.

Further, in the above embodiments, to make a movement mechanism forward thrust force Fdx act on the support member 41, the coupling member 31 was tilted outward from the block, but when, for example, the movement mechanism forward thrust force Fdx is sufficiently small compared with the block rotating force F1 etc., as forces acting on the support member 41 and pushing member 42, the block rotating forces F1 and F1' are dominant. For this reason, in such a case, the coupling member 31 may also be tilted inward to the block so that the other end part of the block coupling member 31 is positioned at the cylinder block 2 side from the one end part.

Further, in the above embodiments, the control shaft 30 was supported by bearings 12 provided at the crankcase 1 and coupling members 31 were used to connect the control shaft 30 and the cylinder block 2, but conversely from this, for example, it is also possible to support the control shaft 30 by bearings provided at the cylinder block 2 and use the coupling members 31 to connect the control shaft 30 and crankcase 1. That is, the block movement mechanism 3 may also be configured by a single control shaft 30 extending in parallel with the crankshaft 10 and supported by the cylinder block 2, coupling members 31 for connecting the eccentric parts 30*b* of the control shaft 30 and the crankcase 1, and an actuator 32 for making the control shaft 30 rotate in two directions within a predetermined range of rotation. Similar effects can be obtained as the above embodiment even if doing this. Further, if configuring the internal combustion engine 100 in this way, it is possible to obtain effects similar to the above embodiments by attaching the other end parts to the eccentric parts 30*b* and the one end parts to the crankcase 1 so that one end parts of the coupling members 31 are positioned at the outside of the internal combustion engine 100 from the other end parts.

Further, in the above embodiments, the two coupling members 31 connect the eccentric part 30*b* of the control shaft 30 and the cylinder block 2, but number of the coupling members 31 is not limited to two and can be increased or decreased as necessary.

REFERENCE SIGNS LIST

1. crankcase
2. cylinder block
3. block movement mechanism
10. crankshaft
30. control shaft
30*a*. main shaft part
30*b*. eccentric part
31. coupling member
32. actuator
40. guide walls
41. support member
42. pushing member
100. internal combustion engine

What is claimed is:

1. An internal combustion engine provided with a cylinder block able to move relative to a crankcase and a cylinder head attached to the top part of the cylinder block, comprising:

a block movement mechanism arranged at just one side of the internal combustion engine when viewing the internal combustion engine from an axial direction of a crankshaft that is supported at the crankcase and the block movement mechanism configured to make the cylinder block move relative to the crankcase;

support members supporting a first side surface of the cylinder block; and pushing members pushing against the side surface of the cylinder block at a position opposite to where the first side surface is being supported by the support members, wherein the block movement mechanism comprises:

a single control shaft supported by one of the crankcase or the cylinder block and having a main shaft part and eccentric parts with an axial center at a position offset by a predetermined amount from the axial center of the main shaft part;

coupling members with one end parts of the coupling members attached to the eccentric parts and with the other end parts attached to the crankcase or the cylinder block and connecting the control shaft and the other of the crankcase or the cylinder block; and an actuator for making the control shaft rotate within a predetermined range of rotation in both directions to make the axial center of the eccentric parts swing about the axial center of the main shaft part in the direction of relative movement of the cylinder block, and wherein the support members comprise a first support member and a second support member that are provided on a side of arrangement of the block movement mechanism while separated by predetermined intervals in the direction of relative movement of the cylinder block, and respectively support the side surface of the top side and the bottom side of the cylinder block, and the pushing members comprise a first pushing member and a second pushing member that are provided at the opposite side of arrangement of the block movement mechanism while separated by predetermined intervals in the direction of relative movement of the cylinder block, and respectively push the side surface of the top side and the bottom side of the cylinder block, and wherein the first support member supports the side surface of the cylinder block at a position where a block rotating force trying to make the cylinder block rotate toward the block movement mechanism about the control shaft when the fuel is burned is applied, and the second pushing member pushes the side surface of the cylinder block located on the bottom side of the cylinder block relative to the first support member.

2. The internal combustion engine according to claim 1, wherein the control shaft is supported by the crankcase, and the coupling members are attached at one end parts to the eccentric parts and at other end parts to the cylinder block so that the other end parts are positioned outside of the internal combustion engine from the one end parts.

3. The internal combustion engine according to claim 1, wherein the control shaft is supported by the cylinder block, and the coupling members are attached at other end parts to the eccentric parts and at the one end parts to the crankcase so that the one end parts are positioned outside of the internal combustion engine from the other end parts.

4. The internal combustion engine according to claim 1, wherein the crankcase supports the crankshaft so that the axial center of the crankshaft is arranged at a position separated by a predetermined distance from the center axis of a cylinder formed at the cylinder block, and the block movement mechanism is arranged at an opposite side to a direction of separation of the axial center of the crankshaft from the center axis of the cylinder.

5. The internal combustion engine according to claim 1, further comprising guide walls provided at the crankcase so as to cover the surroundings of the side surfaces of the cylinder block, wherein the first support member and the second support member are attached to the guide wall at a side of arrangement of the block movement mechanism, and the first pushing member and the second pushing member are attached to the guide wall at an opposite side to the side of arrangement of the block movement mechanism.

* * * * *